US011097195B2

(12) United States Patent
Huffman et al.

(10) Patent No.: US 11,097,195 B2
(45) Date of Patent: Aug. 24, 2021

(54) ROTATING PLAY DEVICE

(71) Applicant: PlayCore Wisconsin, Inc., Chattanooga, TN (US)

(72) Inventors: Jonathan Huffman, Grants Pass, OR (US); Tim Millard, Grants Pass, OR (US); Wesley Hutchinson, Selma, OR (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 0 days.

(21) Appl. No.: 16/579,076

(22) Filed: Sep. 23, 2019

(65) Prior Publication Data

US 2020/0094151 A1 Mar. 26, 2020

Related U.S. Application Data

(60) Provisional application No. 62/734,685, filed on Sep. 21, 2018.

(51) Int. Cl.
*A63G 1/14* (2006.01)

(52) U.S. Cl.
CPC ..... *A63G 1/14* (2013.01)

(58) Field of Classification Search
CPC ... A63G 1/14; A63G 9/00; A63G 9/02; A63G 9/12; A63G 9/14; A47D 13/00; A47D 13/105; A47D 13/107; A63B 22/001; A63B 2208/0204; A45F 3/22
USPC ..... 472/14
See application file for complete search history.

(56) References Cited

U.S. PATENT DOCUMENTS 1,854,173 A * 4/1932 Blink ..... A63G 1/14 472/14
2,464,446 A * 3/1949 Helms ..... A47D 13/105 472/120
2,524,967 A * 10/1950 Ellis ..... A47D 13/105 472/120
2,646,281 A * 7/1953 Hurst ..... A63G 1/20 472/14
2,843,379 A * 7/1958 Merritt ..... A63G 1/42 472/14
2,860,689 A * 11/1958 Baker ..... A47D 13/105 472/118
D265,611 S * 8/1982 Knudson ..... D6/347
(Continued)

*Primary Examiner* — Michael D Dennis
(74) *Attorney, Agent, or Firm* — McAndrews, Held & Malloy, Ltd.

(57) ABSTRACT

The present invention relates to a rotating play device, such as may be mounted to a play surface of an outdoor playground. The rotating play device includes a central post and an upper framework, e.g. upper ring, rotatably mounted to the central post. The device further includes a lower ring suspended from the upper framework by a plurality of cords. During rotation about the central post, the device is configured such that one or more children may (i) stand on the lower ring and hold the upper ring, (ii) sit on the lower ring and hold one or more of the plurality of cords, or (iii) both (i) and (ii). In some embodiments, at least one of the lower ring and the upper ring may be angled to provide a varying distance between the two rings and/or the cords may be flexible such that a user may modify the distance between the lower ring and upper framework at a given riding location.

16 Claims, 5 Drawing Sheets

(56) References Cited

U.S. PATENT DOCUMENTS

| | | | | |
|---|---|---|---|---|
| 5,580,317 | A * | 12/1996 | Yun | A63G 9/00 472/120 |
| 7,485,046 | B2 * | 2/2009 | Dekker | A63B 7/00 472/135 |
| 9,511,296 | B2 * | 12/2016 | Bertschy | A63G 9/00 |
| 2009/0137328 | A1 * | 5/2009 | Wingerstahn | A63G 1/12 472/14 |
| 2014/0000026 | A1 * | 1/2014 | Ou | A45F 3/22 5/120 |

* cited by examiner

ROTATING PLAY DEVICE

The present application claims priority to U.S. Provisional Application No. 62/734,685, filed on Sep. 21, 2018, the entirety of which is incorporated by reference herein.

BACKGROUND

Among the many varieties of playground equipment that may commonly be found at playgrounds are rotating play devices, also sometimes referred to as spinners. The present disclosure is related to a new rotating play device that provides a number of benefits over conventional spinners.

SUMMARY OF THE INVENTION

The present invention relates to a rotating play device, such as may be mounted to a play surface of an outdoor playground.

Embodiments of the rotating play device include a central post and an upper framework, e.g. upper ring, rotatably mounted to the central post. The device further includes a lower ring suspended from the upper framework by a plurality of cords. By virtue of being suspended from the upper framework, the lower ring rotates around the central post in unison with the upper ring. During rotation about the central post, the device is configured such that one or more children may (i) stand on the lower ring and hold the upper ring, (ii) sit on the lower ring and hold one or more of the plurality of cords, or (iii) both (i) and (ii).

In some embodiments, the lower ring may be angled with respect to the upper ring such that the distance between the upper ring and the lower ring varies (e.g. the cords may be of different lengths). For instance, in some embodiments, the upper ring may be substantially parallel to a play surface on which the device is mounted (i.e. substantially perpendicular to a vertical central post) and the lower ring may be angled up to 20 degrees (e.g. between 3 degrees and 20 degrees) with the play surface. By providing the lower ring with an angled orientation, the rotatable play device may both (i) allow children of different heights to operate the device in a comfortable and effortless manner and (ii) make it easier for a child to generate and maintain a spinning motion.

In some embodiments, the upper ring may be angled with respect to a play surface on which the device is mounted (rather than parallel with the play surface). The lower ring may also be angled with respect to the play surface or the lower ring may be parallel with the play surface. In some embodiments, the upper ring and the lower ring may each be angled with respect to the play surface. For instance, in some embodiments, the upper ring and the lower ring may be at substantially the same angle with the play surface, i.e. all of the cords may be of the same or substantially the same length.

In some embodiments, the cords may also be flexible such that a user may be able to move the lower ring up and down. In that way, the distance between the upper ring and the lower ring may be adjustable at any given user location. This too, may also make it easier for a child to generate and maintain a spinning motion, e.g. by pumping his or her body weight up and down during rotation.

Further, in some embodiments, the cords may be unevenly spaced around at least one of the upper ring and the lower ring. This may provide the device with riding positions having varying widths, which may allow the device to better accommodate children of varying size. For instance, by dividing the lower ring into a plurality of subsections of different lengths, one creates standing and/or seating platforms having different sizes. Accordingly, a child may select a platform having a desired size—either a wider platform where the cords are spaced further apart or a shorter platform where the cords are spaced closer together—to accommodate his or her body size and/or desired riding position.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
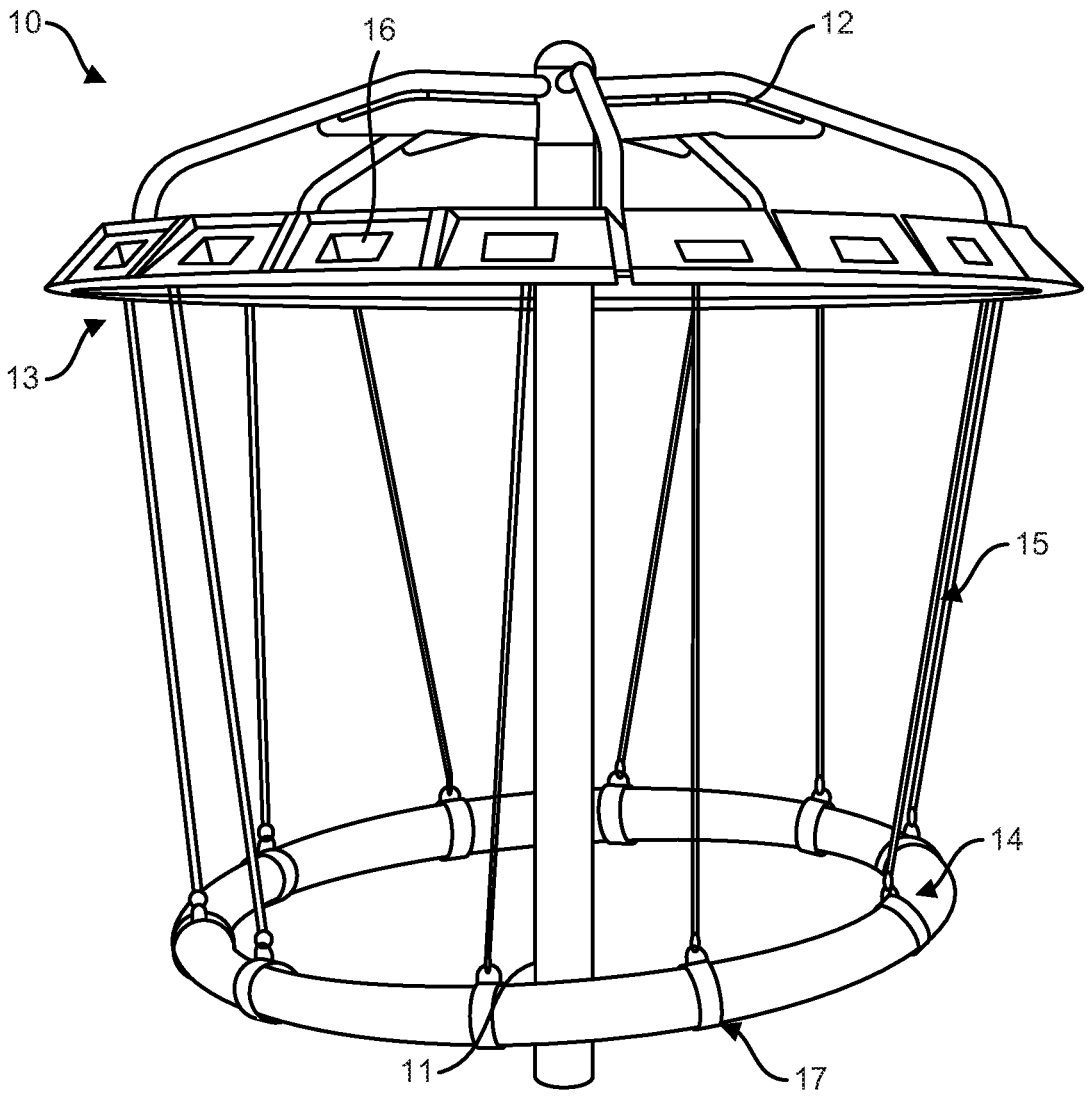
FIG. 1 is a perspective view of a rotating play device according to an embodiment of the present disclosure.
Figure 2:
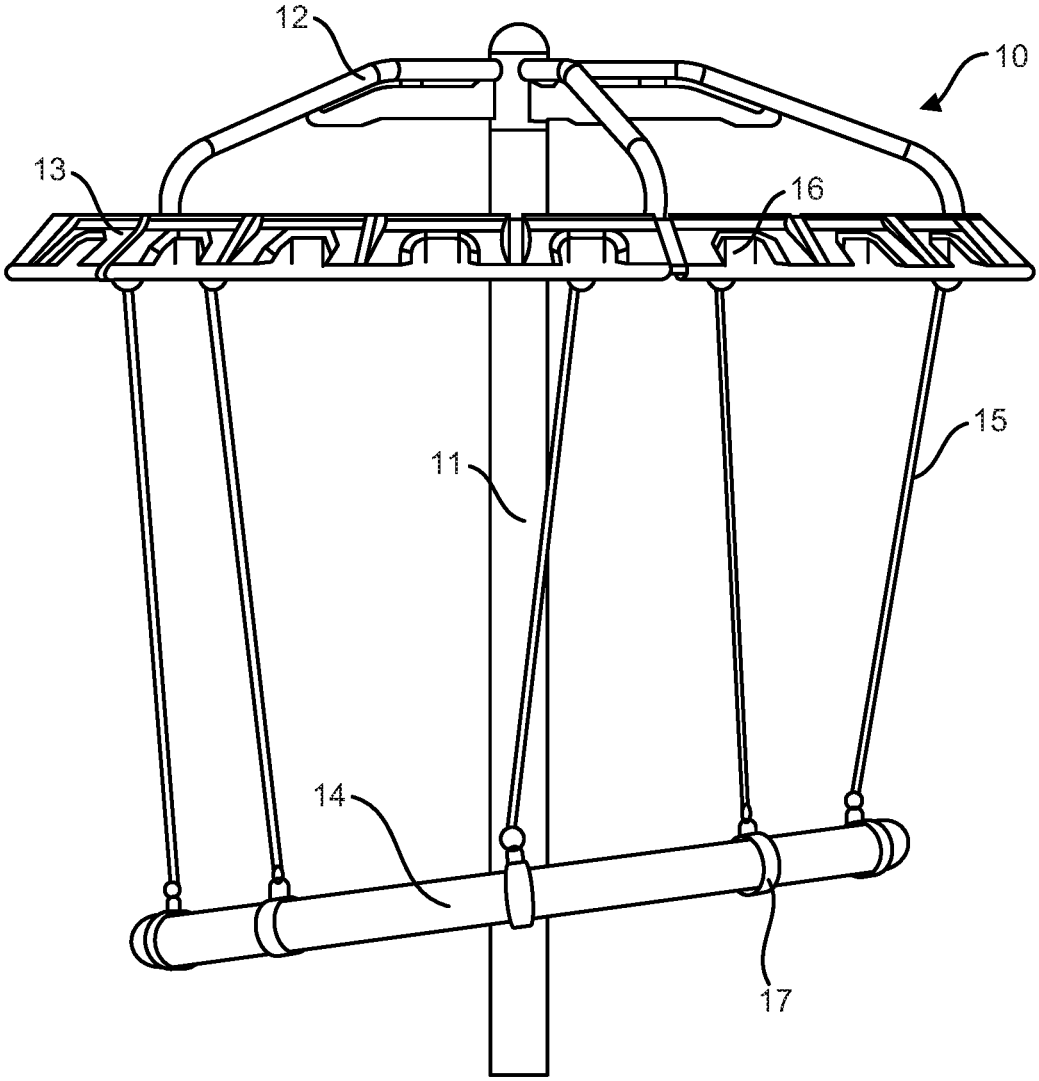
FIG. 2 is a side elevation view of the rotating play device of FIG. 1.
Figure 3:
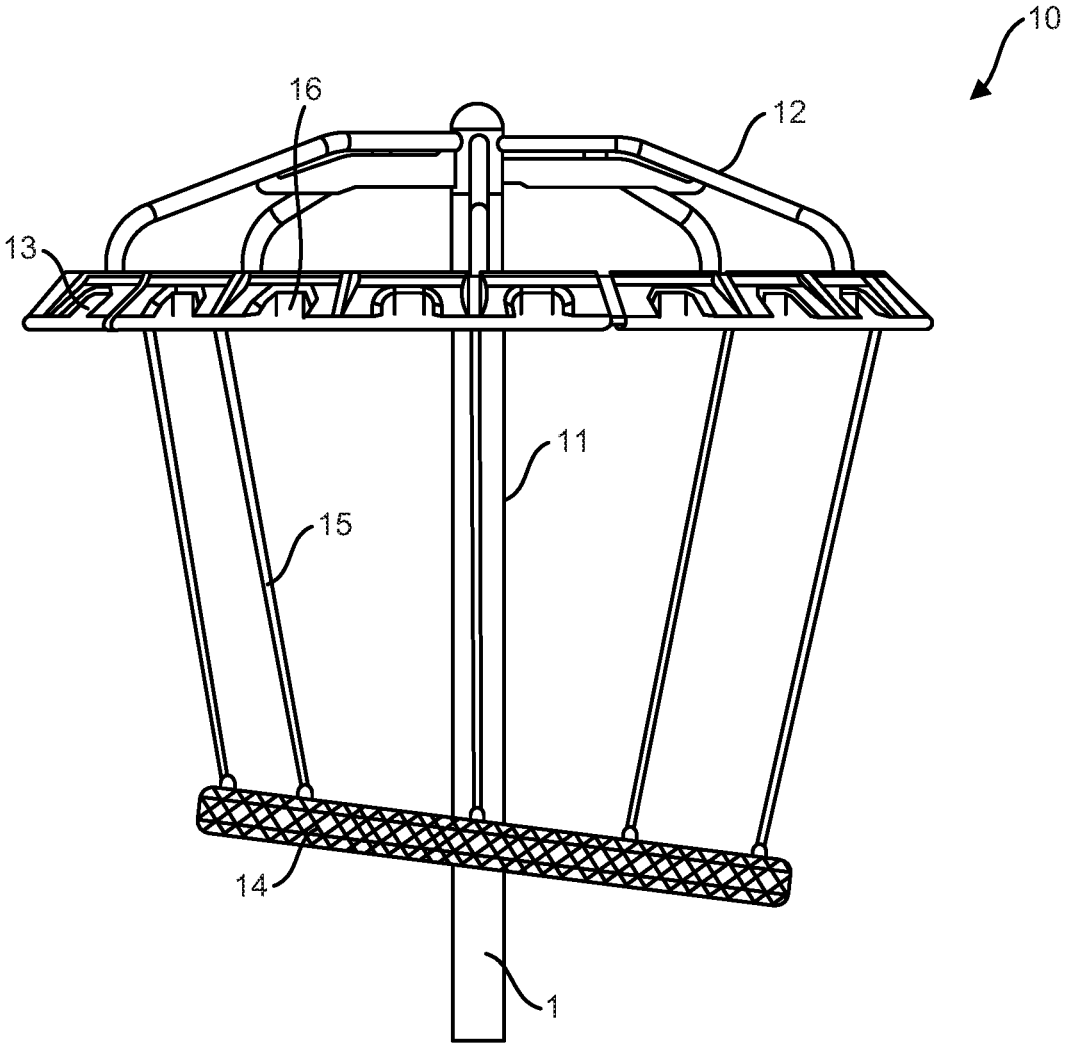
FIG. 3 is a perspective view of the rotating play device of FIG. 1, showing one of its intended uses by children.

Embodiments of the present disclosure are directed to a rotating play device 10 for the enjoyment of children, such as in a playground setting. A first embodiment of the rotating play device 10 is shown in FIGS. 1-3.

The rotatable play device 10 shown in FIGS. 1-3 comprises a central post 11, a framework 12 that includes an upper ring 13, a lower ring 14, and a plurality of cords 15 that suspend the lower ring below the upper ring.

The central post 11 comprises a bottom end and a top end. The bottom end of the central post 11 may be configured to be mounted to a play surface such that the central post extends substantially vertically above the play surface.

Framework 12 is rotatably mounted to the central post 11. The framework 12 may be rotatably mounted to the central post 11 using any of a variety of connections, as are generally understood in the art. In some embodiments, such as that illustrated in FIGS. 1-3, the framework 12 may be mounted at or near the top end of the central post.

In the illustrated embodiment, framework 12 comprises a plurality of support bars that extend outward from a central hub to an upper ring 13. The shape of the support bars, the number of support bars, and the like can be altered to suit a particular design aesthetic without departing from the scope of the present disclosure. The upper ring 13 may be integral with the framework 12 or it may be attached to the framework, e.g. using conventional fasteners. In the illustrated embodiment, the framework 12 comprises an integral upper ring 13, which is covered by an attachment. The optional attachment may serve to conceal the connections between the cords 15 and the framework 12. The attachment may also comprise a plurality of handles 16, which provide easily identified gripping locations for children. In other embodiments, such as where the attachment is omitted, handles 16 may be built directly into the upper ring 13 or framework 12. Alternatively, the upper ring 13 itself may serve as a continuous handle.

A lower ring 14 is suspended from the framework 12 or upper ring 13 by a plurality of cords 15, such that the lower ring rotates about the central post 11 in association with framework 12 and upper ring 13.

Lower ring 14 may be produced from any of a variety of materials. In some embodiments, for instance, lower ring 14 may be braided rope, rubber, metal, composite materials, or the like. In some embodiments, the lower ring may include a wear-resistance and/or weather-resistant outer sleeve. For instance, in some embodiments, the lower ring may comprise a Kevlar sleeve, e.g. the lower ring 14 may comprise a rubber interior structure containing a Kevlar sleeve. In some embodiments, for instance, the lower ring 14 may comprise a metal plate having a substantially flat upper surface. The metal plate may be perforated to prevent rain from pooling on the upper surface. In other embodiments, the lower ring 14 may be a braided rope or composite cord material.

Figure 4:
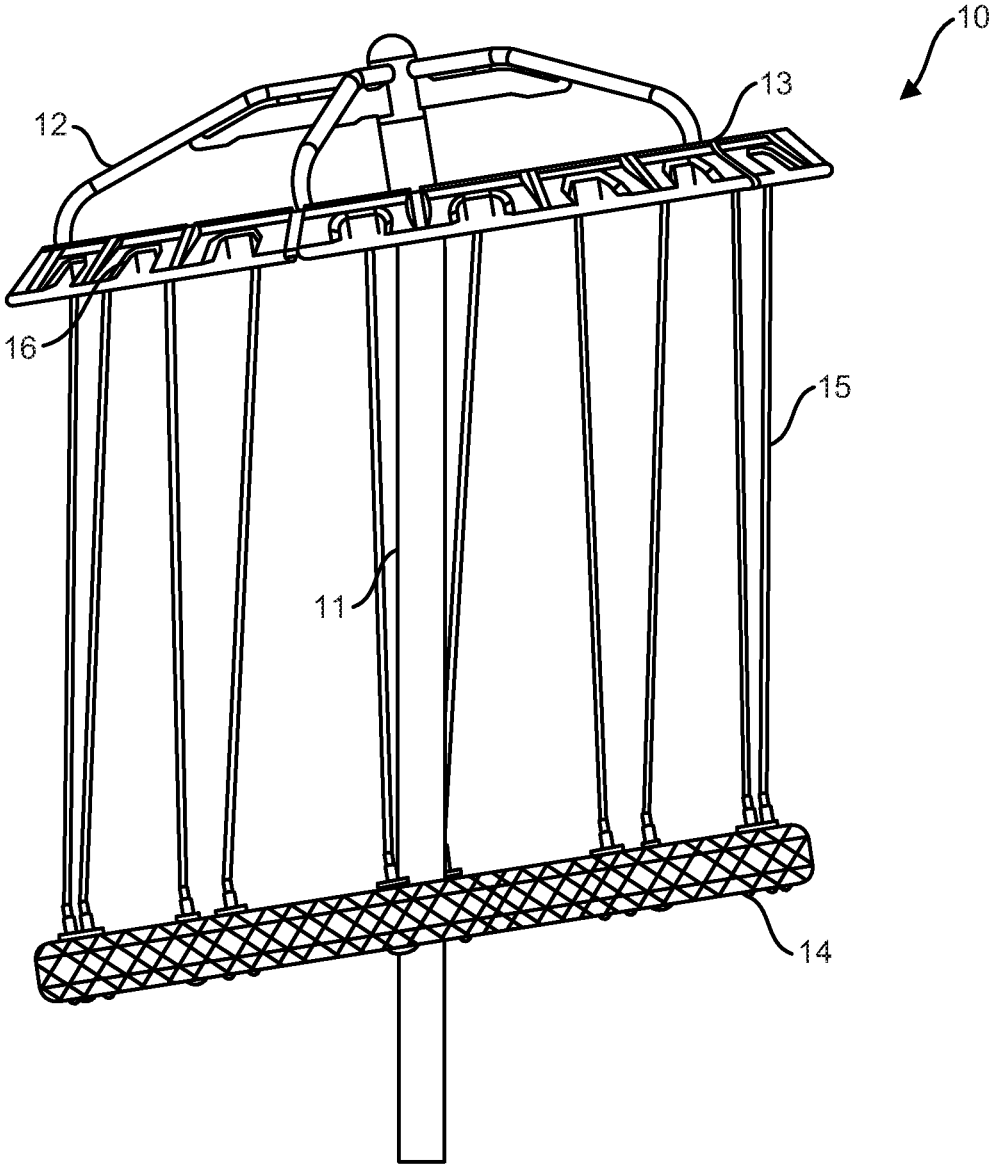
FIG. 4 is a perspective view of a rotating play device according to another embodiment of the present disclosure.
Figure 5B:
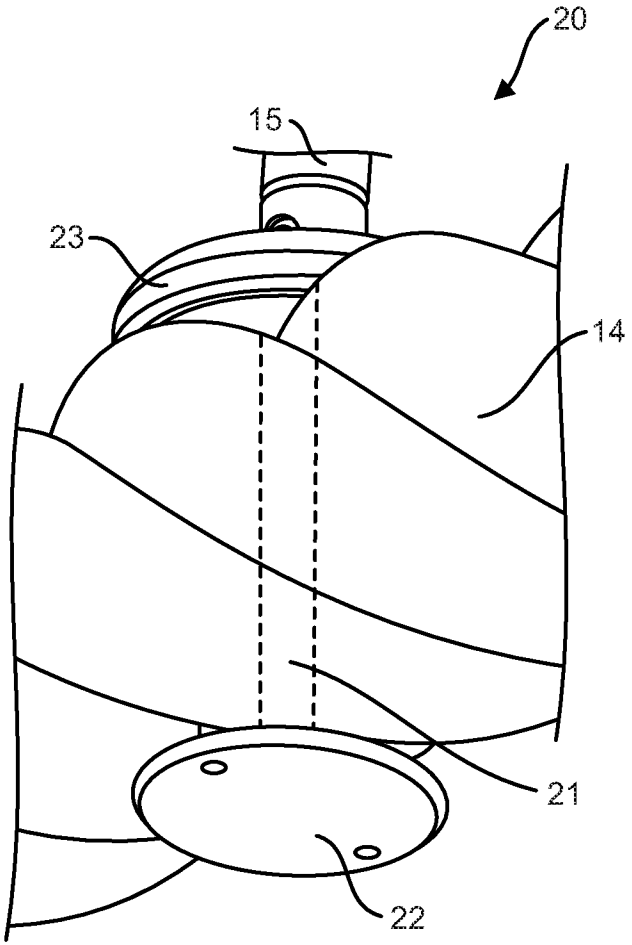
FIG. 5B is a lower perspective view of the embodiment shown in FIG. 5A.
Figure 5A:
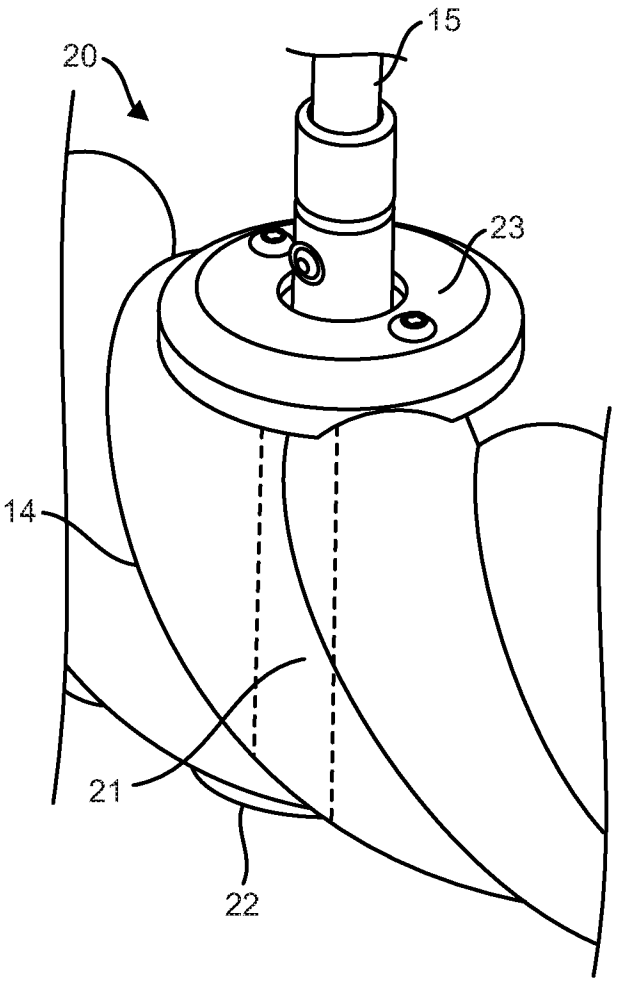
FIG. 5A is an upper perspective view of an embodiment of an attachment of a cord to the lower ring.

In some embodiments, including that shown in FIGS. 1-3, the plurality of cords 15 may be connected to the lower ring 14 by a plurality of collars 17. Each collar 17 may surround the lower ring and contain a connection point for attachment of a cable. As in the illustrated embodiment, the collars may be clamps, which provides for easy installation. In other instances, such as where the lower ring 14 comprises a braided rope or composite cord as shown in FIG. 4, connection points for the plurality of cables 15 may comprise an element that is inserted into the top surface of the ring 14, such as by screwing a connector directly into the material that makes up the ring. An example of such a connection is shown in FIGS. 5A and 5B. In that embodiment, the connector 20 comprises a central element 21 that is inserted through the material that makes up the lower ring 14. Connector 20 also comprises a lower plate 22, and an upper plate 23, each of which is affixed to (or integral with) the central element 21 and each of which prevents the connector from being pulled through and detached from the lower ring 14 (as well as providing stability to the connection). Where the lower ring 14 is a metal plate, the plurality of cables may be attached through a series of mounting plates, which may be affixed to the metal plate through conventional fasteners, e.g. screws, bolts, or the like.

In some embodiments, the lower ring 14 may be horizontal or substantially horizontal. In other words, lower ring 14 may be substantially parallel with the play surface to which the rotatable play device 10 is mounted. In other embodiments, including that illustrated in FIGS. 1-3, for example, the lower ring 14 may be angled with respect to the play surface and with respect to the upper ring 13. In the embodiment illustrated in FIGS. 1-3, for instance, the lower ring 14 is angled with respect to the upper ring 13 such that the distance between the upper ring and the lower ring varies across the circumference of the rings. Specifically, the upper ring 13 is substantially parallel to the play surface on which the device 10 is mounted and the lower ring is at an angle of about 7.5 degrees from horizontal.

By providing the lower ring 14 with an angled orientation (and the upper ring 13 with a substantially horizontal orientation), the rotatable play device 10 is configured so that children of different heights can operate the device in a comfortable and effortless manner. For instance, a taller child may find it most comfortable to stand at the lower portion of the lower ring 14, i.e. where the distance between the lower ring 14 and the upper ring 13 is greatest. A shorter child on the other hand may not be able to reach the upper ring 13 at that location. Instead, a shorter child may stand at the higher portion of the lower ring 14, i.e. where the distance between the lower ring and the upper ring 13 is smallest, at which the child may comfortably grasp the upper ring 13. Providing the lower ring 14 with an angled orientation may also assist a child, especially when operating the device 10 alone, to generate and maintain a spinning motion.

In some embodiments, the lower ring 14 may be angled between about 3 degrees and about 20 degrees with respect to horizontal (i.e. with respect to the play surface to which the device 10 is mounted), alternatively between about 3 degrees and about 15 degrees, alternatively between about 5 degrees and about 15 degrees, alternatively between about 5 degrees and about 10 degrees.

In some embodiments, including for example the embodiment shown in FIG. 4, the framework 12 including the upper ring 13 may be angled with respect to horizontal (i.e. with respect to the play surface to which the device 10 is mounted). For instance, the upper ring 13 may be angled between about 3 degrees and about 40 degrees with respect to horizontal, alternatively between about 5 degrees and about 30 degrees, alternatively between about 5 degrees and about 20 degrees. In those embodiments, the lower ring 14 may be substantially horizontal in order to provide the varying distances between upper and lower rings 13, 14 described above. Or, as illustrated in FIG. 4, the lower ring 14 may also be angled to a similar degree or to the same degree as the upper ring 13.

The cords 15 used to connect the lower ring 14 to the framework 12 may also have a variety of configurations. As used herein, the term cord(s) should be understood broadly to include cables, ropes, and the like. In some embodiments, including that illustrated in FIGS. 1-3, the cords 15 may be substantially rigid, such that the distance between the upper ring 13 and the lower ring 14 is substantially fixed. In other embodiments, however, the cords 15 may be flexible, such that the distance between the upper ring 13 and the lower ring 14 may be variable, i.e. such that a user can cause the lower ring to move up and down. In those embodiments, a child may be able to generate and/or maintain a spinning motion by pumping his or her body weight up and down repeatedly during rotation.

The cords 15 may be attached to the framework 12, e.g. the upper ring 13, and to the lower ring 14 such that the cords span vertically or substantially vertically between the upper and lower rings. However, in some embodiments, including for instance the embodiment shown in FIGS. 1-3, it may be desirable that one or more of the plurality of cords 15 does not span vertically, but rather at some angle to vertical. For instance, in the illustrated embodiment, some cords span from a location at the upper ring 13 downward to a location on the lower ring 14 that is offset in one direction or another around the circumference. In this way, the widths between adjacent cords 15 may vary. This creates riding positions having cords 15 of different widths, which allows a child to select a riding position that he or she finds most comfortable.

In some embodiments, the cords 15 may be evenly spaced around the upper ring 13 and the lower ring 14. In some embodiments, however, including for instance the embodiment shown in FIGS. 1-3, the cords 15 may be unevenly spaced around at least one of the upper ring 13 and the lower ring 14. By spacing the cords 15 unevenly around at least one of the upper and lower rings 13, 14, the device 10 is provided with riding positions having varying widths, which may allow the device to better accommodate children of varying size.

In particular, where the cords 15 are unevenly spaced around the lower ring 14, as is shown in FIGS. 1-4, the lower ring may be divided into a plurality of subsections, with at least two of the subsections having different lengths. This creates standing/seating platforms having different sizes. Accordingly, a child may select a standing/seating platform having a desired size, either a wider platform where the cords are spaced further apart or a shorter platform where the cords are spaced closer together.

A child or a caretaker may cause the upper ring 13 and the lower ring 14 to rotate about the central post 11, such as by grabbing and manually spinning the upper and/or lower ring or by pushing off of the play surface while standing or sitting on the lower ring. During rotation about the central post 11, the device 10 is configured for one or more children to stand on the lower ring 14 and hold onto the upper ring 14 or sit on the lower ring 14 and hold onto one or more of the plurality of cords 15. As shown in FIG. 3, multiple children can operate and ride the device 10 at the same time, creating a social play experience. Multiple children may also experiment with different riding positions in order to learn which alignments and riding positions provide the most sustainable spinning motion.

It can be seen that the described embodiments provide unique and novel rotatable play devices 10 that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A rotating play device comprising:

a central post;

a framework rotatably mounted to the central post, the framework comprising an upper ring;

a lower ring suspended from the framework by a plurality of cords, such that the lower ring also rotates around the central post;

wherein, during rotation of the framework about the central post, the device is configured for one or more children to (i) stand on the lower ring and hold the upper ring, (ii) sit on the lower ring and hold one or more of the plurality of cords, or (iii) both (i) and (ii); and wherein the plurality of cords comprises three or more cords, and wherein at least one of the cords spans from a location at the upper ring to a location at the lower ring that is offset circumferentially, such that the spaces between adjacent cords are uneven, with at least a first space having a greater circumferential length at the lower ring than at the upper ring and at least a second space having a greater circumferential length at the upper ring than at the lower ring.

2. The rotating play device of claim 1, wherein in a rest position, the upper ring is substantially parallel to a play surface on which the device is mounted and the lower ring is at an angle between about 3 degrees and about 20 degrees with the play surface, such that the distance between the upper ring and the lower ring varies.

3. The rotating play device of claim 1, wherein the upper ring comprises a plurality of handles.

4. The rotating play device of claim 1, wherein each of the plurality of cords is attached to the lower ring by a collar.

5. The rotating play device of claim 1, wherein each of the plurality of cords is attached to the lower ring by connection element that is inserted into the lower ring.

6. The rotating play device of claim 1, wherein the cords are rigid, such that the lower ring is fixed.

7. The rotating play device of claim 1, wherein the cords are flexible, such that the lower ring is movable up and down.

8. The rotating play device of claim 1, wherein in a rest position the upper ring is not parallel with a play surface on which the device is mounted.

9. The rotating play device of claim 8, wherein in a rest position the upper ring is angled between about 5 and about 40 degrees with the play surface.

10. The rotating play device of claim 8, wherein in a rest position the lower ring is also not parallel with a play surface on which the device is mounted.

11. The rotating play device of claim 10, wherein in a rest position each of the upper ring and the lower ring are angled at substantially the same angle with the play surface.

12. The rotating play device of claim 11, wherein in a rest position the upper ring and the lower ring are each angled between about 5 and about 40 degrees with the play surface.

13. A rotating play device comprising:

a central post;

a framework rotatably mounted to the central post, the framework comprising an upper ring;

a lower ring suspended from the framework by a plurality of cords, such that the lower ring also rotates around the central post;

wherein, during rotation of the framework about the central post, the device is configured for one or more children to (i) stand on the lower ring and hold the upper ring, (ii) sit on the lower ring and hold one or more of the plurality of cords, or (iii) both (i) and (ii); and wherein, in a rest position, the lower ring is angled with respect to the upper ring such that a distance between the upper ring and the lower ring varies.

14. The rotating play device of claim 13, wherein, in a rest position, the upper ring is substantially parallel to a play surface on which the device is mounted and the lower ring is at an angle between about 3 degrees and about 20 degrees with the play surface.

15. The rotating play device of claim 14, wherein, in a rest position, the lower ring is at an angle between about 5 degrees and about 15 degrees with the play surface.

16. The rotating play device of claim 13, wherein, in a rest position, the upper ring is not parallel with a play surface on which the device is mounted and wherein the lower ring is parallel with a play surface on which the device is mounted.

* * * * *